US005178336A

United States Patent [19]

Lodovico et al.

[11] Patent Number: 5,178,336

[45] Date of Patent: Jan. 12, 1993

[54] MACHINE FOR CUTTING DISPOSABLE CONTAINERS

[75] Inventors: Frank J. Lodovico, Delmont, Pa.; John W. Wagner, Rte. 1, Box 943, New Alexandria, Pa. 15670

[73] Assignee: John. W. Wagner, New Alexandria, Va.

[21] Appl. No.: 775,159

[22] Filed: Oct. 11, 1991

[51] Int. Cl.[5] ..... B02C 18/16

[52] U.S. Cl. ..... 241/99; 241/167; 241/236

[58] Field of Search ..... 241/99, 166, 167, 236

[56] References Cited

U.S. PATENT DOCUMENTS

| | | | |
|---|---|---|---|
| 2,770,302 | 12/1956 | Lee | 83/114 |
| 3,033,064 | 5/1962 | Lee | 83/114 |
| 3,931,935 | 1/1976 | Holman | 241/24 |
| 4,068,805 | 1/1978 | Oswald | 241/159 |
| 4,565,330 | 1/1986 | Katoh | 241/236 |
| 4,693,428 | 9/1987 | Raterman et al. | 241/167 |
| 4,702,422 | 10/1987 | Chambers, Sr. et al. | 241/46.06 |
| 4,729,515 | 3/1988 | Wagner | 241/99 |
| 4,923,126 | 5/1990 | Lodovico et al. | 241/30 |
| 5,074,479 | 12/1991 | Lamar | 241/101.7 |

FOREIGN PATENT DOCUMENTS

| | | | |
|---|---|---|---|
| 249359 | 8/1911 | Fed. Rep. of Germany . | |
| 1291606 | 3/1969 | Fed. Rep. of Germany . | |
| 2526650 | 12/1976 | Fed. Rep. of Germany . | |
| 2723281 | 12/1978 | Fed. Rep. of Germany . | |
| 3231341 | 3/1984 | Fed. Rep. of Germany . | |
| 3313231 | 10/1984 | Fed. Rep. of Germany . | |
| 45173 | 7/1935 | France . | |
| 136597 | 10/1980 | Japan . | |
| 3232860 | 9/1988 | Japan . | |
| 1558423 | 1/1980 | United Kingdom . | |
| 2059804 | 4/1981 | United Kingdom | 241/236 |

*Primary Examiner*—Mark Rosenbaum
*Assistant Examiner*—John M. Husar
*Attorney, Agent, or Firm*—James L. Sherman

[57] ABSTRACT

An improved machine for cutting into small pieces the thin wall material of disposable containers includes parallel, rotating cutting shafts having a plurality of cutting wheels thereon. The cutting wheels are separated by annular spacers which provide a rotating comber surface. There is a spacer comber partially encircling each of the annular spacers which has a lower section having a rounded surface. A cutting wheel comber partially encircles each of the cutting wheels and has a lower end with a rounded portion. The spacer combers having the rounded surface and the cutting wheel combers having the rounded portion prevent the collection of the small pieces within the improved machine.

16 Claims, 2 Drawing Sheets

MACHINE FOR CUTTING DISPOSABLE CONTAINERS

BACKGROUND OF THE INVENTION

1. Field of Invention

This invention relates to a machine which is capable of cutting any one of numerous sizes of disposable containers such as plastic bottles and/or metal cans into small pieces and to such a machine which is configured to insure that the small pieces are directed below the cutting area of the machine for collection and disposition.

2. Description of the Prior Art

U.S. Pat. No. 4,923,126, which is incorporated by reference in its entirety herein, discloses a machine which is capable of cutting into small pieces the thin wall material of a plurality of disposable containers such as plastic bottles and metal cans. The cutting section of the machine includes a pair of parallel shafts mounted for rotation in opposite directions about the center axes thereof. Each of the shafts rigidly supports a plurality of overlapping cutting wheels for rotation therewith. Each cutting wheel has a plurality of identical cutting teeth with each tooth having an apex at the maximum diameter and a root at a root diameter of the cutting wheel. Each cutting tooth has a leading surface and a trailing surface which meet at the apex to form a straight edge at the maximum diameter which is parallel to the center axis of the shaft. The leading surface and the trailing surface respectively lie in planes which are parallel with the center axis of the shaft and extend toward the same side thereof to cause the straight edge of the apex to circumfrentially lead a remainder of the leading surface during rotation of the cutting wheel.

The basic cutting wheel configuration has been found to effectively and reliably produce the small pieces of the containers as disclosed therein. Generally, the embodiment in U.S. Pat. No. 4,923,126 is configured to cause most of the small pieces to be ejected downwardly from the cutting area between the cutting wheels. A dispersing section below the cutting area is intended to disperse the small pieces throughout a collecting section therebelow. The small pieces are received within a container in the collecting section and eventually removed for further disposition. However, it has been found that suctioning or vacuuming means disposed in the lower area of the machine is preferred in order to transport the small pieces to a larger container remote from the machine itself. In either case, it is clearly desirable that all of the small pieces produced in the cutting section be discharged from the cutting area and to be prevented from collecting around the cutting wheels or the cutting shafts.

As further discussed in U.S. Pat. No. 4,923,126, such machines are typically utilized for the cutting of disposable containers employed in the soft drink industry. As a result, there have been continuing problems with the cutting of such disposable containers which have not typically existed in the operation of other types of cutting machines found in the prior art. The soft drink liquid remaining in the disposable containers has been found, in a short time of operation, to completely engulf the interior of the container cutting machine. The liquid is extremely corrosive and the sugary substance can cause even greater problems when heated. The friction created by the rotating cutting wheels can produce a build up of solid, corrosive by-products that can seriously reduce the effectiveness and even the life of the machine. Additionally, because the soft drink liquid is deposited on many of the small pieces produced by the cutting machine, the small pieces also become sticky and tend to collect in the area of the cutting wheels to present significant problems with continued and effective operation of the machine. As a result, it is desirable for the cutting section to be configured to prevent the collection of such corrosive and destructive pieces therein.

In order to determine an effective way for preventing the collection of such small pieces in the cutting section of the machine, it is appropriate to analyze the types of combing means which have been employed in other cutting or shredding machines which were not specifically adapted for the cutting and shredding of containers found in the soft drink industry.

One group of such devices disclosed in prior art patents includes some form of combing means located at the backside of the spacer element between the cutting wheels. These spacer combers prevent the collection of pieces or strips of material between the cutting wheels at the backside thereof. Various cutting machines including such combing configurations are disclosed in U.S. Pat. No. 3,931,935; British Patent No. 1,558,423; German Patentschrift No. 249,359; German Auslegeshrift No. 1,291,606; and German Offenlegungsschrift Nos. 2,526,650; 2,723,281; 3,231,341; and 3,313,231.

All of the devices disclosed in these patents are characterized by the inclusion of some type of separate or integrally formed annular spacer ring between adjacent cutting wheels or discs on one shaft. The annular spacer ring tends to serve as a rotating comber for the aligned cutting wheel or disc on the other shaft. As a result, the pieces or strips of material are maintained in close proximity with the cutting wheel or disc by which they are formed. The spacer ring rotates in the direction of movement through the cutting area to facilitate the formation of the pieces or strips and their passage through the cutting area of the machine.

The devices disclosed therein are also characterized by the inclusion of a fixed "combing" means or "scraping" device which tends to prevent the collection of any material around the rotating spacer ring. The location of the fixed combing means at the lower or rear region of each spacer ring would prevent the collection of the strip or piece material at the backside of the spacer ring remote from the cutting area. However, as will be seen, the general shape and form of such combing means may not be satisfactory for the "combing" or "scraping" of the small pieces formed from soft drink containers because of the soft drink liquid tending to form and collect thereon.

Another group of cutting or shredding machines also includes additional means for preventing the collection of small pieces of material at the remote side of the cutting wheels themselves rather than simply at the remote or backside of the spacer ring. Such cutting or shredding machines are disclosed in U.S. Pat. No. 4,068,805; French Patent No. 45,173; and Japanese Patent Nos. 55-136597 and 63-232860. All of these machines apparently incorporate a solid comber block or backing member which occupies the space within the housing at the backside of both the rotating cutting wheels and the spacer rings therebetween. Such configurations will again tend to prevent most of the pieces or strips from being carried about the interior of the machine with the rotating cutting discs and spacers. To a greater or lesser degree, each of these prior art comber configurations will tend to prevent the collection of such pieces or strips in the region remote from the cutting area. However, as will be seen later, the particular configurations of the prior art combing devices aligned with the cutting discs and with the spacer rings do not entirely prevent the undesired collection of the type of small pieces produced by the cutting of plastic bottles and/or metal cans found in the soft drink industry.

All of the U.S. and foreign patents discussed hereinabove are incorporated by reference as if included in their entirety herein.

SUMMARY OF THE INVENTION

It is therefore an object of the present invention to provide a machine for cutting disposable containers such as plastic bottles and metal cans into small pieces while insuring that the small pieces do not collect in the cutting machine at the backside of the cutting wheels or the spacer rings therebetween.

It is another object to provide such a machine including a combing means which will prevent such undesired collection of small pieces at the backside of the cutting wheels and spacer rings while also preventing any collection on the combing means itself.

It is a further object to provide such a machine which effectively prevents any undesired collection of the small pieces therein and thus improves the reliability and extends the life of the machine.

These and other objects are provided in a preferred embodiment of the invention including an improved machine capable of cutting into small pieces the thin wall material of a plurality of disposable containers such as plastic bottles or metal cans. The machine being of a type which includes a pair of parallel cutting shafts mounted for rotation about central axes thereof in opposite directions. Each of the cutting shafts supports a plurality of cutting wheels mounted for rotation therewith. Each of the cutting wheels on one of the cutting shafts axially separates and extends between axially adjacent cutting wheels on the other of the cutting shafts. Each cutting wheel has a plurality of cutting teeth thereon. An annular spacer is mounted on the cutting shaft between the adjacent cutting wheels for rotation therewith. The annular spacer has a cylindrical outer surface. The cutting teeth on the cutting wheels are capable of producing cutting the thin wall material to form the small pieces in a cutting area between the cutting shafts for discharge below the cutting wheels. The improvement includes a spacer comber having a cylindrical inner surface and being fixedly mounted with the cylindrical inner surface aligned with the cylindrical outer surface of the annular spacer in a circumferential region thereof remote from the cutting area. The spacer comber has a lower section disposed below the central axis and at a side thereof remote from the cutting area. The lower section has a rounded surface. A cutting wheel comber is fixedly mounted remote from the cutting area and aligned with each cutting wheel. The cutting wheel comber has a concave surface adjacent to and partially surrounding the cutting wheel. The concave surface of the cutting wheel comber terminates at a lower end at a rounded portion of the cutting wheel comber. The rounded portion is located below the central axis and at the side thereof remote from the cutting area.

The cylindrical outer surface and the cylindrical inner surface preferably have a radial distance therebetween which is less than a minimum predetermined thickness of the thin wall material of the containers.

In the preferred embodiment, the concave surface has an intermediate region which is located above said central axis. The intermediate region is a first predetermined distance from the cutting wheel for restricting passage of the small pieces therebetween. Still further, the lower end of the concave surface of the cutting wheel comber is at a second predetermined distance from the cutting wheel and the second predetermined distance is larger than the first predetermined distance. The upper end of the concave surface is at a third predetermined distance from the cutting wheel and the third predetermined distance is larger that the first predetermined distance.

The improved machine can include the first predetermined distance of between about 0.08 inch to about 0.10 inch. The second predetermined distance is preferably at least three times the first predetermined distance.

The improved machine is configured to include the cutting wheels including side surfaces and being sharpened by grinding the side surfaces thereof. Each cutting wheel is narrowed by the surface grinding. The annular spacer, the spacer comber, and the cutting wheel comber are narrowed by respective corresponding grinding of respective side surfaces thereof. As a result, the improved machine is overhauled, after the grinding and the corresponding grinding, by the addition of at least one of the cutting wheels, the annular spacer, the spacer combers and the cutting wheel spacers on each of the cutting shafts.

The invention can include a machine for cutting into small pieces the thin wall material of a plurality of disposable containers such as plastic bottles or metal cans. The thin wall material has a minimum predetermined thickness. The machine includes a pair of parallel cutting shafts mounted for rotation about central axes thereof in opposite directions. Each of the cutting shafts supports a plurality of cutting wheels mounted for rotation therewith. Each cutting wheel on one of the cutting shafts extends between and axially separates axially adjacent cutting wheels on the other cutting shaft. Each cutting wheel has a plurality of cutting teeth thereon. The cutting teeth are identical and evenly spaced about on outer periphery of the cutting wheel. The cutting teeth have an apex to form a straight edge to produce a transverse cut of the thin wall material. The cutting teeth have side edges to produce longitudinal cuts of the thin wall material. The transverse cuts and the longitudinal cuts form the small pieces in a cutting area between the cutting shafts. An annular spacer is mounted on each cutting shaft between each of the adjacent cutting wheels for rotation therewith. The annular spacer has a cylindrical outer surface. A spacer comber has a cylindrical inner surface. The spacer comber is fixedly mounted with the cylindrical inner surface aligned with the cylindrical outer surface of the annular spacer in a circumferential region thereof remote from the cutting area. The spacer comber has a lower section. The lower section is disposed below the central axis and at a side thereof remote from the cutting area. The lower section has a rounded surface. A cutting wheel comber is fixedly mounted remote from the cutting area and aligned with each cutting wheel. The cutting wheel comber has a concave surface adjacent to and partially surrounding each cutting wheel. The concave surface of the cutting wheel comber terminates at a lower end at a rounded portion of the cutting wheel comber. The rounded portion is located below the central axis and at the side thereof remote from the cutting area. The concave surface has an intermediate region. The intermediate region is located above the central axis. The intermediate region is a first predetermined distance from each cutting wheel for restricting passage of the small pieces therebetween.

The machine can further include the lower end of the concave surface of the cutting wheel comber being at a second predetermined distance from each cutting wheel and the second predetermined distance being larger than the first predetermined distance. The second predetermined distance is at least about three times the first predetermined distance. An upper end of said concave surface can be at a third predetermined distance from each cutting wheel with the third predetermined distance being larger than the first predetermined distance.

The machine can also include each cutting wheel having side surfaces. Each cutting wheel is sharpened by surface grinding the side surfaces. Each cutting wheel is narrowed by the surface grinding. The annular spacer, the spacer comber, and the cutting wheel comber are narrowed by respective corresponding surface grinding of respective side surfaces thereof. The machine is overhauled, after the surface grinding and the corresponding surface grinding, by the addition of at least one of each of the cutting wheels, the annular spacer, the spacer combers and the cutting wheel spaces on each cutting shaft.

DETAILED DESCRIPTION OF THE PREFERRED EMBODIMENT

Figure 1:
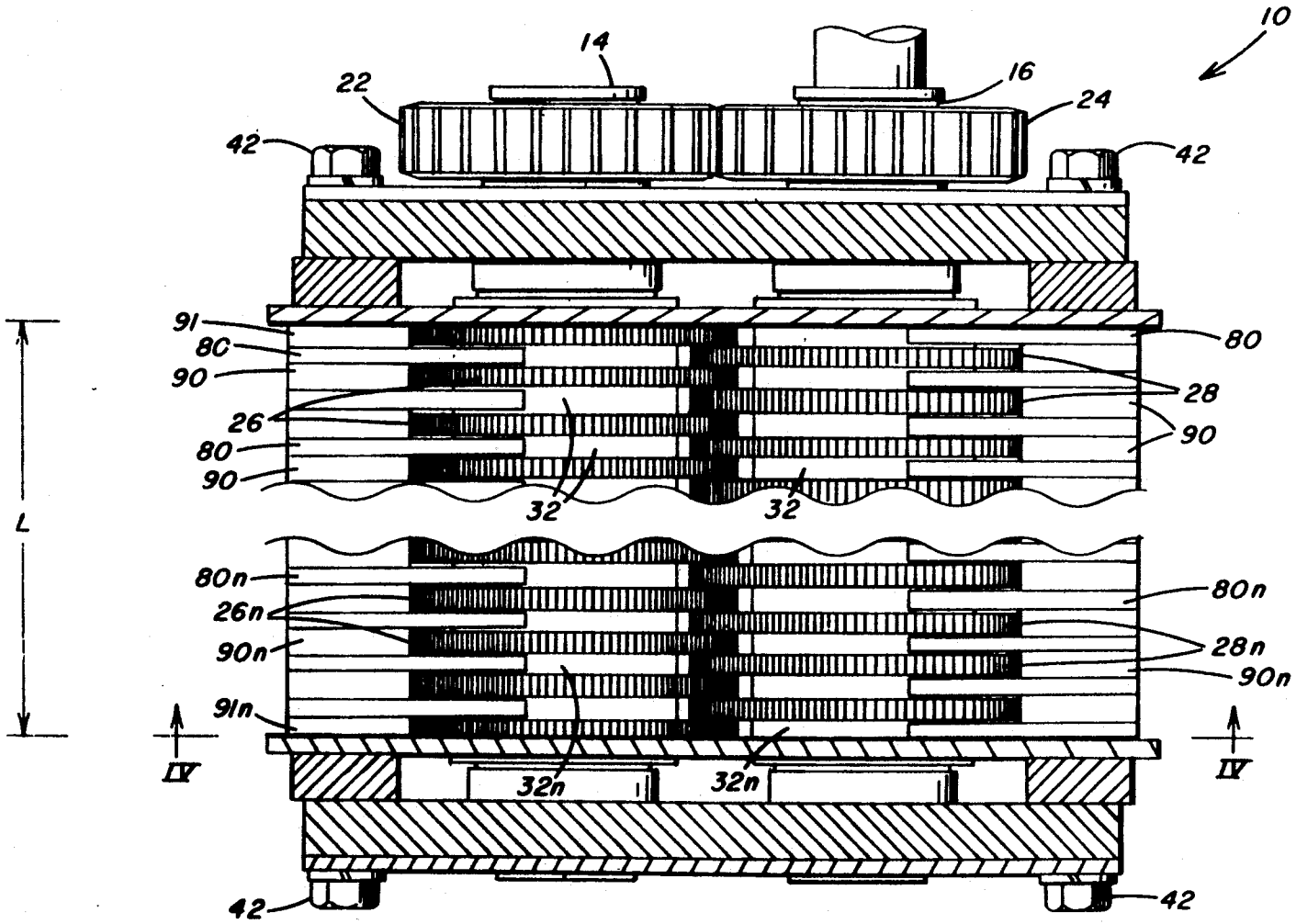
FIG. 1 is a fragmentary, sectional top view of the preferred cutting machine including various features of the invention. The upper portion of FIG. 1 includes components of the cutting machine as initially installed and the lower portion includes the components after the machine is overhauled.
Figure 4:
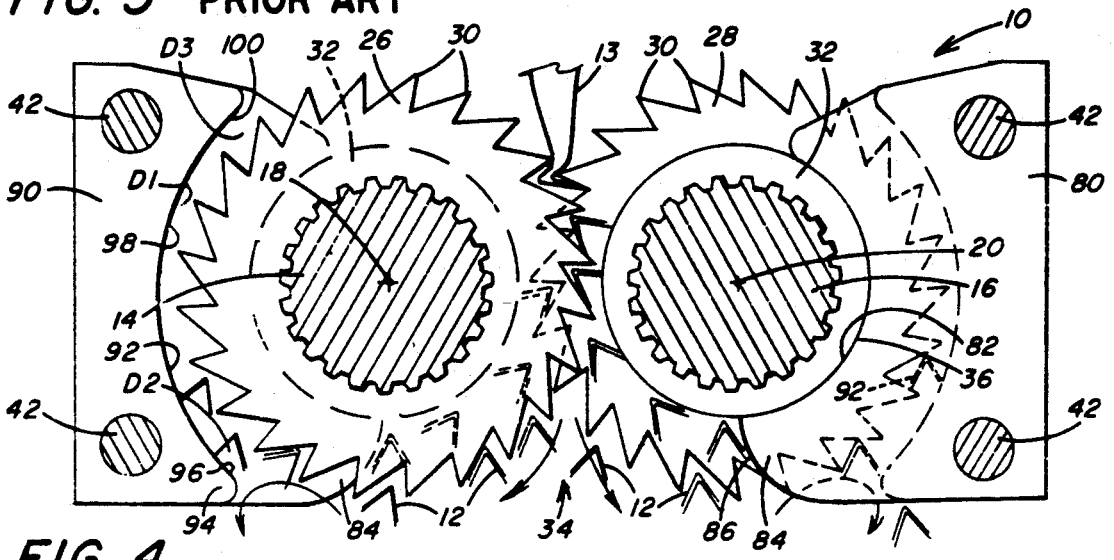
FIG. 4 is a side view of the cutting machine as seen along Line IV—IV of FIG. 1 including various features of the invention.

As seen in FIGS. 1 and 4, a preferred improved cutting machine 10 is capable of cutting into small pieces 12 the thin wall material 13 of a plurality of disposable containers such as plastic bottles or metal cans. The cutting machine 10 includes a pair of parallel cutting shafts 14,16 mounted for rotation about their central axes 18,20 in opposite directions. The cutting shaft 16 is coupled to a motor and reduction gear configuration (not shown) to cause rotation in the counter-clockwise direction as seen in FIG. 4. The shaft 16 includes a gear 24 which is engaged with a gear 22 on the shaft 14 in order to produce the opposite rotation of the shafts.

Each shaft 14,16 includes a plurality of external splines for the receipt of matching internal splines of a center opening of each a plurality of cutting wheels 26,28. The cutting wheels 26,28 are identical and include a plurality of cutting teeth 30 thereon. When each cutting wheel is installed on a shaft, it is indexed with respect to the previously installed cutting wheel. As a result, the teeth 30 are disposed in a helical array to produce more even and effective cutting.

The configuration of cutting wheels 26,28 with the cutting teeth 30 thereon is identical to the basic configuration disclosed in U.S. Pat. No. 4,923,126, discussed hereinabove. Although the machine disclosed therein included a similar tooth configuration, the machine 10 includes a larger shaft, a larger cutting wheel opening, and spline mounting therebetween. Additionally, a different annular spacer 32 has been employed to maintain the spacing between adjacent cutting wheels 26 on the shaft 14 and between adjacent cutting wheels 28 on the shaft 16. Generally, the shafts in the prior cutting machine of U.S. Pat. No. 4,923,126 were smaller and did not have the large splines as provided in the preferred cutting shafts 14,16 of the present invention. The cutting wheels of the device disclosed in U.S. Pat. No. 4,923,126 were keyed to the shafts to produce the generally helical array of teeth about the shafts as discussed above. The annular spacers disclosed therein were primarily intended to maintain the axial spacing of the cutting wheels on their respective shafts. Consequently, the general "combing" of the material through the cutting wheels was provided by an array of separately attached and configured combers.

However, in the preferred machine 10 of FIGS. 1 and 4, each shaft 14,16 includes an array of annular spacers 32 with matching splines and a larger outside diameter to maintain the space between axially adjacent cutting wheels on the respective shafts 14,16. The larger spacers 32 tend to provide a rotating, combing function in order to facilitate the passage of the thin wall material and the resulting small pieces 12 therethrough. It had been found in the machine of U.S. Pat. No. 4,923,126 that some of the small pieces 12 would begin to collect on the flat lower surfaces of the fixed combers near the cutting area. The preferred rotating annular spacers 32, which provide basic combing in the machine 10, facilitate better movement of the small pieces 12 through the cutting area 34.

In either case, the type of cutting produced by the cutting wheels 26,28 is identical to that basically produced by the machine disclosed in U.S. Pat. No. 4,923,126. The plastic bottles or metal cans are directed between the cutting wheels 26,28 by a feeding paddle configuration (not shown). The cutting wheels 26 are angularly displaced with respect to the cutting wheels 28. Just prior to cutting, the general alignment of each cutting tooth 30 on one of the cutting wheels 26,28 is between the preceding adjacent cutting teeth and the following adjacent cutting teeth on the other cutting wheel 28,26 of the other shaft. Basically, the thin wall material is entrapped between the trailing edges of the preceding cutting teeth and the leading edges of the following cutting teeth as the particular cutting tooth 30 begins to bend the thin wall material of the container. With continued rotation, the apex of the cutting tooth 30 produces a transverse cut while the side edges of the overlapping teeth produce a pair of longitudinal cuts to complete the formation of each of the small pieces 12. This cutting process is fully disclosed in U.S. Pat. No. 4,923,126 which is incorporated by reference herein.

While the machine 10, as described, effectively and reliably produces the plurality of small pieces 12, there still remains a need to prevent the undesired collection and retention of some of the small pieces 12 within the cutting machine 10.

As discussed hereinabove, there is a continuing concern that the corrosive material and/or small pieces of the containers including the corrosive material will collect in the cutting machine 10. The retention of the small pieces 12 or the corrosive material even in areas remote from the actual cutting area 34 between the shafts 14,16, can be detrimental to the effective operation of the machine. The array of combers disclosed in U.S. Pat. No. 4,923,126 have generally been found to successfully prevent the collection of small pieces 12 at the backside of each of the spaces established between the cutting wheels by the spacer rings. However, the formation of the small pieces including the soft drink fluid thereon results in the small pieces tending to collect on the flat, straight surfaces of the fixed combers at the lower region of the cutting area.

With the inclusion of the rotating annular spacers 32, one might assume that such collection of small pieces at the lower region of the cutting area 34 would be eliminated. Clearly, passage through the cutting area 34 is enhanced by the rotating annular spacers 32. On the other hand, some means must be provided for actually "combing" or "stripping" the small pieces from the cylindrical outer surface 36 of the annular spacers 32. With rotating annular spacers generally employed in other types of cutting or shredding machines in the past, one might expect that some type of fixed comber configuration employed in these prior art machines would be adaptable for use in the preferred cutting machine 10 of the present invention.

Figure 2:
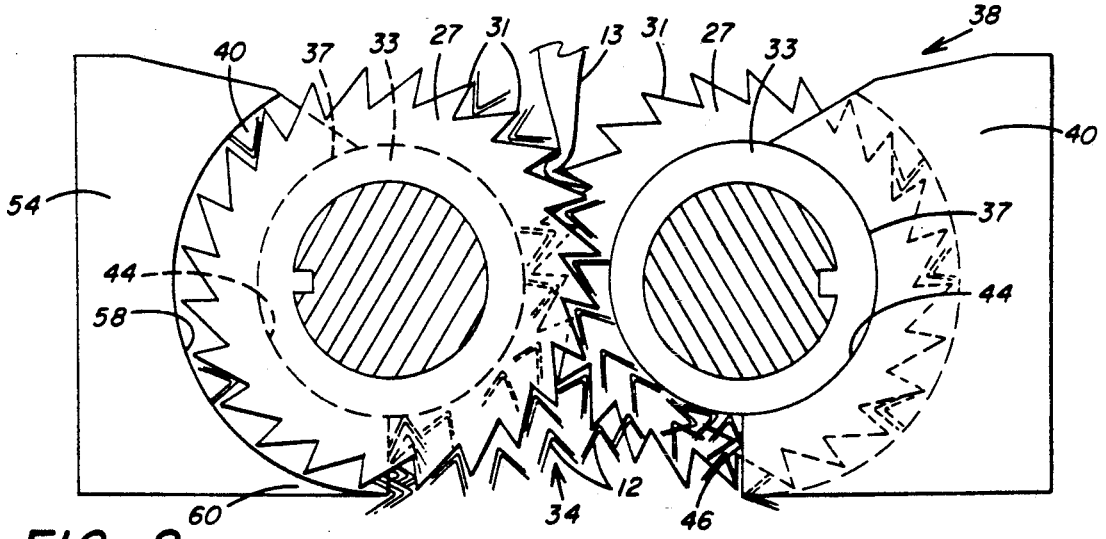
FIG. 2 PRIOR ART
FIG. 2 is a side view of a prior art comber configuration including the preferred cutting wheels.
Figure 3:
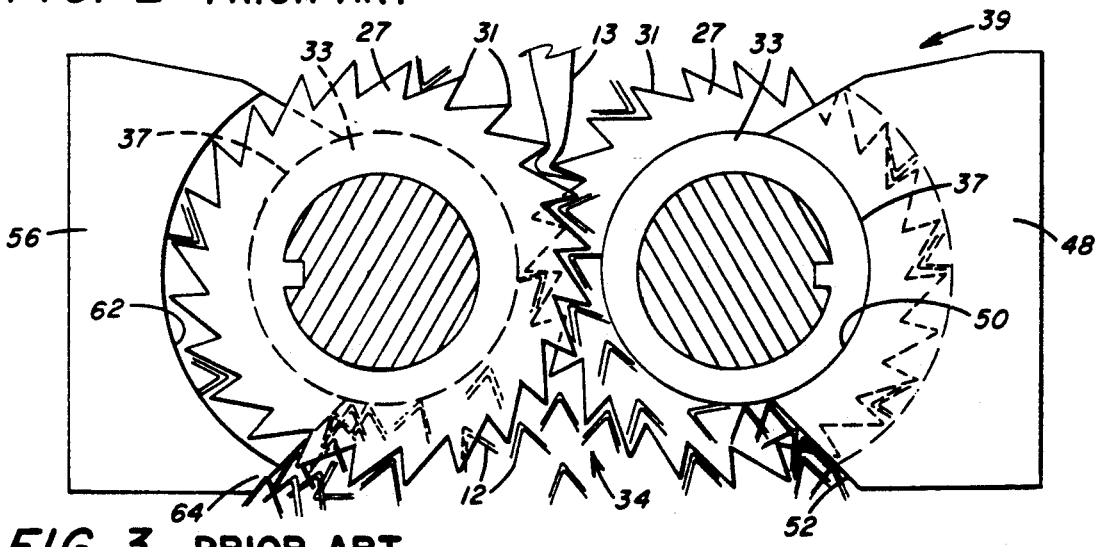
FIG. 3 PRIOR ART
FIG. 3 is a side view of another prior art comber configuration including the preferred cutting wheels.

As respectively seen in FIGS. 2 and 3, two such prior art combing configurations 38,39 have been employed to "comb" or "strip" the small pieces 12 from a cylindrical outer surface 37 of each rotating spacer 33 and the circumferential area of each cutting wheel 27. The configuration 38 of FIG. 2 includes a spacer comber section 40 at the side of the shafts remote from the cutting area 34. The spacer comber section 40 has a cylindrical inner surface 44 aligned with and closely disposed about the cylindrical outer surface 37 of the rotating spacer 33. Significantly, a lower end of the spacer comber section 40 includes a flat, vertical surface 46 with a similar alignment as the surface at the lower end of the combers employed in the machine of U.S. Pat. No. 4,923,126. The general arrangement employed in the prior art spacer comber section 40 shown in FIG. 2 is similar to the spacer combers employed in several cutting or shredding machines in the patents discussed hereinabove.

For example, German Auslegeshrift No. 1,291,606 includes a vertically disposed combing element which is very near the cutting area and, therefore, would have a similar effect as did the fixed comber of U.S. Pat. No. 4,923,126. On the other hand, the spacer comber section 40 of the prior art configuration 38 is similar to the spacer comber configurations shown in French Pat. No. 45,173 and at one of the cutting wheel arrays of Japanese Patent No. 55-136597. More specifically, the surfaces at the lower end of the spacer comber configurations are generally aligned with the central axes of the cutting shafts to provide generally vertical surfaces for the impingement of the small pieces thereon. As seen in FIGS. 2, although the surface 46 is located generally away from the cutting area 34, it has been found that the flat planar surface 46 still results in an undesirable collection of the small pieces 12 thereon. Continued collection at the surface 46, while not specifically preventing proper cutting in the cutting machine, clearly complicates its extended operation and could eventually reduce the overall effectiveness of the cutting machine 10.

As seen in FIG. 3, another prior art combing configuration 39 includes a spacer comber section 48 which again includes a cylindrical inner surface 50 which closely encircles the cylindrical outer surface 37 of the spacer 33. However, the lower end of the spacer comber section 48 includes a flat planar surface 52 which is inclined away from the cutting area 34. This surface 52 is similar to that found in U.S. Pat. No. 3,961,935; British Patent No. 1,558,423; German Offenlegungsschrift Nos. 2,526,650 and 2,723,281; and at one of the cutting wheel arrays of Japanese Patent No. 55-136597. From these prior art spacer combers and the general concept of the planar surface being inclined away from the cutting area 34, one might assume that no collection of small pieces 12 would occur thereon. However, as seen in FIG. 3, it has been found that the small pieces 12 having soft drink material deposited thereon still tend to collect in a manner which could be detrimental to the overall operation of the cutting machine 10.

The other prior art devices discussed hereinabove do not have a vertical or inclined surface below the cutting area. Instead, the devices of German Patentschrift No. 249,359; German Offenlegungsschrift Nos. 3,231,341 and 3,313,231; U.S. Pat. No. 4,068,805; and Japanese Patent No. 63-232860 include configurations in which a small comber section between the cutting wheels is confined to a small limited area to the rear of the cutting shaft. Such a configuration might prevent the undesired transporation of small pieces around the shaft on the cylindrical outer surface of the spacer but would not prevent undesired collection in other regions generally remote from the cutting area at the backside of the spacers.

Consequently, it can be seen that the spacer comber sections of the prior art configurations shown in FIGS. 2 and 3, and in the various patents discussed hereinabove, do not provide an appropriate and reliable means for preventing the collection of the small pieces within the cutting machine in the area between the cutting wheels.

However, there is also significant concern regarding the collection of such small pieces of material in the area on the backside of the cutting wheels. The cutting machine disclosed in U.S. Pat. No. 4,923,126 included no combing or other such device to prevent the collection of small pieces in the area aligned with the cutting wheels themselves. As mentioned above, several prior art configurations do include cutting wheel comber sections which are aligned with the region of the cutting wheels remote from the cutting section. U.S. Pat. No. 4,068,805 and Japanese Patent No. 63-232860 include configurations which are only partially disposed at the rear of the cutting wheels and, therefore, would not completely eliminate the collection of small pieces at the side of the shaft remote from the cutting area. On the other hand, French Patent No. 45,173 and Japanese Patent No. 55-135597 have cutting wheel comber sections which are closely aligned with the apexes of the cutting teeth and would therefore appear to prevent the collection of small pieces at the backside of the cutting wheels.

However, it should be noted that the cutting wheels have a plurality of cutting teeth at the outer edge thereof. The cutting wheel comber section cannot extend into the area between the teeth. As a result, any configuration which closely encircles the cutting wheel may prevent the collection of small pieces at the outer surface but would also prevent the removal of any pieces located between the cutting wheel teeth. Undesired retention of the small pieces between the cutting wheel teeth could clearly affect the ability of these teeth to provide the desired cuts when the teeth are rotated to the cutting area.

The prior art combing configuration 38 of FIG. 2 and the prior art combing configuration 39 of FIG. 3 respectively include cutting wheel comber sections 54,56. The cutting wheel comber section 54 of FIG. 2 includes an interior cylindrical surface 58 which closely encircles cutting wheel 27 at the apexes of the cutting teeth 31. As seen, the small pieces 12 can collect at the apexes of the cutting teeth 31 but are not prevented from collecting between the cutting teeth 31. In fact, as indicated above, once the small pieces 12 are located between the cutting teeth 31 and begin to pass along the interior cylindrical surface 58, the interior cylindrical surface 58 prevents the dislodgement or removal of small pieces 12 from between the teeth 31. As a result, the pieces 12 may be returned to the cutting area 34 to interfere with effective cutting of the container. The lower end 60 of the cutting wheel comber section 54 terminates at a point which, at first impression, would appear to "scrape" small pieces 12 from the apexes of the cutting teeth 31. However, as will be seen, the pointed shape at the lower end 60 of the cutting wheel comber section 54 tends to collect small pieces 12 thereon.

The cutting wheel comber section 56 of FIG. 3 also includes a interior cylindrical surface 62 to closely encircle the apexes of the cutting teeth 31. However, the lower end 64 of the cutting wheel comber section 56 has a planar surface which is generally perpendicular to the interior cylindrical surface 62. Being located further from the center axis of the shaft to be more remote from the cutting area 34, one might think that the small pieces 12 would not tend to collect thereon. However, it has been found that the small pieces 12 which are not entrapped between the cutting wheel teeth 31 tend to collect on the planar surface at the lower end 64 in the same manner as generally discussed for the spacer comber sections of the prior art.

Clearly, from the discussion of the embodiments shown in FIGS. 2 and 3 and those disclosed in the patents mentioned hereinabove, none of the prior art combing means will insure that the small pieces, which are produced by the cutting of plastic bottles and metal cans in the soft drink industry, will not collect below the cutting area or in the region of the shaft remote from the cutting area.

It is significant that both the combing configurations 38,39, although not shown in sections in FIGS. 2 and 3, are provided as integrally formed elements like each of the prior art devices in the patents which included combing at both the annular spacer rings and the cutting wheels. Such an integral construction will prevent the collection of small pieces 12 at the remote side of the shafts. However, the actual shape and form provided in the prior art configurations of FIGS. 2 and 3 will not effectively prevent other forms of collection of the small pieces 12 which can be detrimental to the cutting of the containers throughout the life of the machine.

As seen in FIGS. 1 and 4, the preferred cutting machine 10 includes the array of cutting wheels 26,28 with an identical tooth design as the prior art combing configurations of FIGS. 2 and 3. It is physically impossible for the cutting wheel comber sections to extend into the area between the cutting teeth. A configuration which closely encircles the cutting wheel may prevent some collection of small pieces thereon but would also prevent the removal of any pieces located between the cutting teeth. Undesired retention of the small pieces between the cutting wheel teeth could clearly affect the ability of the teeth to provide the desired cuts when rotated to the cutting area of the cutting machine.

However, the preferred cutting machine 10 employs separate spacer combers 80 and cutting wheel combers 90 including various features of the invention to eliminated many of the problems found in the prior art configurations.

Specifically, the spacer combers 80 are mounted on a pair of rods 42 to include cylindrical inner surfaces 82 aligned with the cylindrical outer surfaces 36 of the annular spacers 32. The radial space between the outer surface 36 and the inner surface 82 is less than the minimum thickness of the material being cut in order to prevent any pieces from becoming lodged between the two cylindrical surfaces.

The lower end 84 of the spacer comber 80 does not include a planar surface as found in the prior art configurations discussed hereinabove. Instead, the lower end 84 includes a curved or rounded surface 86 which generally starts below the center axis 18,20 and curves away from the cutting area 34. It has been found that the small pieces 12, which have small planar surfaces, are less capable of sticking to or collecting on the curved or rounded surfaces 86. Accordingly, the spacer combers 80 effectively "comb" or "scrape" small pieces 12 from the cylindrical outer surfaces 36 of the annular spacers 32. As a result, the small pieces 12 will not collect between the cutting wheels 26,28 in an area remote from the cutting area 34 or on the combining surface below the shafts 14,16 near the cutting area 34 as occurred in the prior art configurations discussed hereinabove.

The preferred machine 10 includes the cutting wheel combers 90 which are also mounted on the rods 42. Each cutting wheel comber 90 includes an interior concave surface 92 adjacent to and partially surrounding the cutting wheel 26,28. The concave surface 92 terminates at a lower end 96 at a rounded portion 94 of the cutting wheel comber 90. The concave surface 92 is spaced from the circular path of the apexes of the cutting teeth 30. An intermediate region 98 of the concave surface 92 is generally located above the central axis 18,20 of each of the shafts 14,16. A first predetermined distance D1 between the concave surface 92 and the cutting teeth 30 thereby at the intermediate region 98 is sufficiently small to restrict passsage of the small pieces therebetween. However, the first predetermined distance D1 is sufficiently large to allow some small pieces, depending on their orientation with respect to the teeth, to pass by the intermediate region 98 if they be retained on the apexes of the teeth 30. More significantly, the distance D1 at 98 is sufficiently large to allow small pieces 12 located between the cutting teeth 30 to at least partially escape from between the cutting teeth 30 by centrifugal force created during the rotation of the cutting wheels 26,28.

The lower end 96 of the concave surface 92 adjacent the rounded portion 94 is at a second predetermined distance D2 from the apexes of the cutting teeth 30 rotating thereby. The second predetermined distance D2 is larger than the first predetermined distance D1.

Consequently, as the small pieces 12 are brought into alignment with the concave surface 92, there is sufficient space at the lower end 96 for the centrifugal forces created on the small pieces 12 by the rotation of the cutting wheels 26,28 to dislodge them from between the cutting teeth 30. In other words, most of the small pieces 12 which might collect between or on the cutting teeth 30 are capable of being dislodged and being directed toward the concave surface 92. The smooth concave surface 92 with a diverging space from the intermediate region 98 to the lower, rounded portion 94 allows most of the small pieces 12 to pass by gravity to an area below the cutting machine 10.

Any pieces tending to collect at the teeth 30 may be dislodged at any point along the concave surface 92. The upper end 100 of the concave surface 92 is at a third predetermined distance D3 from the cutting wheel 26,28 which is larger than the first predetemined distance D1 at the intermediate region 98. Those few pieces which are passed beyond the intermediate region 98 are capable of being cleaned or bumped out at the upper region 100 by the rotation of the cutting wheels 26,28. However, as indicated, most of the small pieces 12 are dislodged prior to their being transported to the intermediate region 98 and therefore fall through the widening space past the rounded portion 94 to be discharged below the machine 10.

The rounded portion 94 is preferred rather than being a pointed area, such as at 60 in the combing configuration 38, or planar, such as at 64 of the combing configuration 39, in order to eliminate the collection of any small pieces thereon. Small pieces 12 may impinge upon the rounded portion 94 but will not collect thereon as occurs with the cutting wheel comber sections of the prior art devices discussed hereinabove.

The preferred machine 10 includes spacer combers 80 and cutting wheel combers 90 which prevent any undesired collection of the small pieces 12 at the backside of the shafts 14,16 remote from the cutting area 34. Further, the shape and form of the preferred spacer combers 80 and cutting wheel combers 90 will prevent the collection of the small pieces 12 on the surfaces thereof as occurs in the prior art configurations.

As mentioned above, all of the prior art configurations providing combing at the spacers and the cutting wheels disclosed in the various patents and shown in FIGS. 2 and 3 were integrally formed. The preferred cutting machine 10 includes separately formed spacer combers 80 and cutting wheel combers 90 mounted on the support rods 42. While formation of individual combers 80,90 may appear to be more complicated, the overall configuration is desirable for use in the cutting machine 10 which is employed to cut the containers found in the soft drink industry. As clearly established hereinabove, the corrosive nature of the soft drink liquid and the overall difficulty of producing such small pieces of the container eventually causes wear to the cutting teeth 30 of the cutting wheels 26,28. When the machine 10 must be overhauled, the cutting wheels 26, 28 are removed from the machine 10 in order to grind the backside of each tooth 30 to sharpen the apexes of the teeth 30. When each apex is sharp, the machine 10 can effectively produce the transverse cuts. However, there is also wear at the side edges of the cutting teeth 30 which could reduce the ability to produce the longitudinal cuts which complete the formation of the small pieces 12.

The preferred machine 10, as generally shown at the upper portion of FIG. 1 and specifically used to cut metal cans, includes ten cutting wheels 26 and nine cutting wheels 28. Each of the cutting shafts 14,16 has an effective length L of about 5.625 inches in the cutting area. To improve the cutting at the side edges of the cutting teeth 30, the machine is disassembled and each of the cutting wheels 26,28 is surface ground to reduce its overall thickness to form narrower cutting wheels **26*n*,28*n*. The amount of surface grinding is sufficient to reduce the overall thickness of the array so that an additional cutting wheel 26*n* and an additional cutting wheel 28*n* can be installed in the machine 10 as seen in the lower portion of FIG. 2. Obviously, this also requires surface grinding of the spacers 32 to form narrower spacers 32*n* and an additional spacer 32*n* is installed on each shaft 14,16 in order to maintain the overall length of the machine 10**.

When reducing the thickness of the cutting wheels 26,28 and the spacers 32 to overhaul the machine 10, the original thickness of each of the combers 80,90 must also be reduced in order to provide proper alignment of narrower combers **80*n*,90*n* with the surface ground cutting wheels 26*n*,28*n* and spacers 32*n*. Any integrally formed combing configuration, such as those found in the prior art devices discussed hereinabove, would no longer be capable of being employed to properly comb the new cutting wheel array. With the preferred configuration of the present invention, the inclusion of an additional set of combers 80*n*,90*n* for each of the shafts 14,16 allows the machine 10** to be overhauled in a manner which was not capable of being accomplished with the prior art comber configurations discussed above.

It should be noted that the overall effective length and the spacing throughout the machine 10 is quite critical. In other words, the preferred machine 10 includes a firm axial alignment and positioning of the cutting wheels 26 and spacers 32 on the shafts 14 and a similar firm array of cutting wheels 28 and spacers 32 on the shaft 16. Any axial movement of the cutting wheels 26,28 which might cause contact between the surfaces thereof is undesirable. Similarly, any undesired axial movement of the combers 80,90 which might allow contact between the comber spacer combers 80 and the cutting wheels 26,28 is also undesirable. Undesired contact by any of these elements could harm the side edges of the cutting teeth and significantly interfere with the ability of the cutting wheels to produce the required longitudinal cut for the formation of the small pieces. Accordingly, the general axial spacing of the combers 80,90 is such that the cutting wheel combers 90 have a slightly greater thickness than do the cutting wheels 26,28. To provide the overall axial spacing, the spacer combers 80 have a slightly smaller thickness than the spacers 32. To provide the overall length required for the machine 10, the array of cutting wheels 26 on the shaft 14 includes slightly thinner cutting wheel combers 91 in each end thereof in order to provide the desired spacing of the overall machine 10. The end cutting wheel combers 91 are identical to the cutting wheel combers 90 except for the thickness thereof in order to provide this desired effective length in the cutting area. Obviously, when the machine 10 is overhauled, the thinner end cutting wheel combers 91 must also be surface ground to provide narrower end cutting wheel combers **91*n* for positioning at the ends of the shaft 14**.

Having basically disclosed the overall operation of the preferred machine 10, it is appropriate to provide specific dimensions of various components therein in order to better understand the function of the machine during the cutting of the containers. As mentioned above, the effective length L of the cutting shafts for the machine 10 which is particularly adapted for cutting metal cans is about 5.625 inches. However, for the cutting of large plastic bottles, the effective length L of the machine 10 is about 8 inches. Clearly, additional cutting wheels, annular spacers, spacer combers, and cutting wheel combers are added to longer shafts in the machine in order to provide the longer effective length L for the cutting of the plastic bottles.

The preferred shafts have a maximum diameter of about 2.40 inches. There are 23 matching splines on each of the cutting shafts and at the interior of each of the cutting wheels and annular spacers thereon. The distance between the central axes of the cutting shafts is about 4 inches. With the cutting wheels having a maximum diameter of about 4.875 inches, the cutting wheels tend to have an overlapping distance of about 0.875 inches in the cutting area therebetween. The preferred cutting wheels have 24 identical teeth thereon.

Each of the preferred cutting wheels, as initially installed in the machine, has a thickness of about 0.2945 inches. Accordingly, the small pieces formed thereby tend to have a width of about 0.2945 inches and a length of about 0.625 inches. The small pieces of the metal cans and of the plastic bottles respectively have a thickness of about 0.010 inches and about 0.020 inches. The small pieces tend to have a characteristic fold in the middle thereof separating planar portions as generally shown in the figures. The preferred annular spacers have a thickness of about 0.296 inches when initially installed to properly separate the cutting wheels. The spacer combers, being intentionally narrower in order to prevent contact with the cutting wheels, have an initial thickness of about 0.245 inches. The cutting wheel combers which, as indicated above, are thicker, have an initial thickness of about 0.344 inches. The first predetermined distance is about 0.08 to about 0.10 inches. The second predetermined distance is about 0.30 to about 0.32 inches. The third predetermined distance is about 0.11 to about 0.14 inches.

Although not shown in FIG. 1, the preferred motor and reduction gear configuration include a electric motor rated at about 2 HP with the reduction gear having a speed reduction of about 25 to 1.

From the disclosure of the prior art machine shown in U.S. Pat. No. 4,923,126, it should be clear that the preferred machine could be configured to include some means for driving a feed paddle configuration above the cutting machine. While the prior art machine included a sprocket and chain mounting for each shaft at the end of the machine opposite from that including the drive gears, details regarding such a feeding means have been omitted from the drawing in order to better disclose the cutting machine itself which is the subject of the present invention. Various alternative configurations well-known in the machine art could be utilized for providing a means for feeding the containers to the machine to be cut thereby and are not considered to be a part of the invention as claimed.

From the description provided hereinabove, it should be clear that various alterations could be made to the preferred machine without departing from the scope of the invention as claimed.

What is claimed is:

1. An improved machine capable of cutting into small pieces the thin wall material of a plurality of disposable containers such as plastic bottles or metal cans, the thin wall material having a minimum predetermined thickness, the machine being of a type which includes a pair of parallel cutting shafts mounted for rotation about central axes thereof in opposite directions, each of the cutting shafts supporting a plurality of cutting wheels mounted for rotation therewith, each of the cutting wheels on one of the cutting shafts axially separating and extending between axially adjacent cutting wheels on the other of the cutting shafts, each of the cutting wheels having a plurality of cutting teeth thereon, an annular spacer mounted on the cutting shaft between each of the adjacent cutting wheels for rotation therewith, the annular spacer having a cylindrical outer surface, the cutting teeth being capable of cutting the thin wall material to form the small pieces in a cutting area between the cutting shafts for discharge below the cutting wheels, wherein said improvement comprises:

a spacer comber having a cylindrical inner surface;

said spacer comber being fixedly mounted with said cylindrical inner surface aligned with the cylindrical outer surface of the annular spacer in a circumferential region thereof remote from the cutting area;

said spacer comber having a lower section;

said lower section being disposed below the central axis and at a side thereof remote from the cutting area; and said lower section having a convex rounded surface which begins at the cylindrical inner surface and which extends uninterrupted downwardly from said cylindrical outer surface of said annular spacer to a location remote from said cutting area.

2. The improved machine according to claim 1, wherein the cylindrical outer surface and said cylindrical inner surface have a radial distance therebetween which is less than the minimum predetermined thickness.

3. The improved machine according to claim 1, further including:

a cutting wheel comber fixedly mounted remote from the cutting area and aligned with each of the cutting wheels;

said cutting wheel comber having a concave surface adjacent to and partially surrounding the cutting wheel at a side thereof remote from the cutting area;

said concave surface of said cutting wheel comber terminating at a lower end at a rounded portion of said cutting wheel comber having a convex surface with a smooth transition between said concave surface and said convex surface; and said rounded portion being located below the central axis and at said side thereof remote from the cutting area.

4. The improved machine according to claim 3, wherein each of the cutting wheels includes side surfaces and is configured to be sharpened by surface grinding the side surfaces thereof;

each of the cutting wheels is configured to be narrowed by said surface grinding;

the annular spacer, said spacer comber, and said cutting wheel comber are configured to be narrowed by respective corresponding surface grinding of respective side surfaces thereof; and the improved machine is configured to be overhauled, after said surface grinding and said corresponding surface grinding, by the addition of at least one of each of the cutting wheels, the annular spacers, said spacer combers and said cutting wheel spacers on each of the cutting shafts.

5. The improved machine according to claim 3, wherein said concave surface has an intermediate region, said intermediate region is located above the central axis, and said intermediate region is a first predetermined distance from the cutting wheel for restricting passage of the small pieces therebetween.

6. The improved machine according to claim 5, wherein said first predetermined distance is between about 0.08 inch to about 0.10 inch.

7. The improved machine according to claim 5, wherein an upper end of said concave surface is at a third predetermined distance from the cutting wheel and said third predetermined distance is larger than said first predetermined distance.

8. The improved machine according to claim 5, wherein said lower end of said concave surface of said cutting wheel comber is at a second predetermined distance from the cutting wheel and said second predetermined distance is larger than said first predetermined distance.

9. The improved machine according to claim 8, wherein said second predetermined distance is at least about three times said first predetermined distance.

10. A machine for cutting into small pieces the thin wall material of a plurality of disposable containers such as plastic bottles or metal cans, the thin wall material having a minimum predetermined thickness, said machine comprising:

a pair of parallel cutting shafts mounted for rotation about central axes thereof in opposite directions;

each of said cutting shafts supporting a plurality of cutting wheels mounted for rotation therewith;

each of said cutting wheels on one of said cutting shafts extending between and axially separating axially adjacent said cutting wheels on the other of said cutting shafts;

said each cutting wheel having a plurality of cutting teeth thereon;

said cutting teeth being identical and evenly spaced about on outer periphery of said cutting wheel;

said cutting teeth having an apex to form a straight edge to produce a transverse cut of said thin wall material;

said cutting teeth having side edges to produce longitudinal cuts of said thin wall material;

said transverse cuts and said longitudinal cuts forming said small pieces in a cutting area between said cutting shafts;

an annular spacer mounted on said each cutting shaft between each of said adjacent cutting wheels for rotation therewith;

said annular spacer having a cylindrical outer surface;

a spacer comber having a cylindrical inner surface;

said spacer comber being fixedly mounted with said cylindrical inner surface aligned with said cylindrical outer surface of said annular spacer in a circumferential region thereof remote from said cutting area;

said spacer comber having a lower section;

said lower section being disposed below said central axis and at a side thereof remote from said cutting area; and said lower section having a convex rounded surface which begins at the cylindrical inner surface and which extends uninterrupted downwardly from said cylindrical outer surface of said annular spacer to a location remote from said cutting area.

11. The machine according to claim 10, wherein the cylindrical outer surface and said cylindrical inner surface have a radial distance therebetween which is less than the predetermined thickness.

12. The machine according to claim 10, further including:

a cutting wheel comber fixedly mounted remote from said cutting area and aligned with said each cutting wheel;

said cutting wheel comber having a concave surface adjacent to and partially surrounding said each cutting wheel at a side thereof remote from the cutting area;

said concave surface of said cutting wheel comber terminating at a lower end at a rounded portion of said cutting wheel comber having a convex surface with a smooth transition between said concave surface and said convex surface;

said rounded portion being located below said central axis and at said side thereof remote from said cutting area;

said concave surface having an intermediate region; said intermediate region being located above said central axis; and said intermediate region being a first predetermined distance from said each cutting wheel for restricting passage of said small pieces therebetween.

13. The machine according to claim 12, wherein an upper end of said concave surface is at a third predetermined distance from said each cutting wheel and said third predetermined distance is larger than said first predetermined distance.

14. The machine according to claim 12, wherein said each cutting wheel includes side surfaces;

said each cutting wheel is configured to be sharpened by surface grinding said side surfaces;

said each cutting wheel is configured to be narrowed by said surface grinding;

said annular spacer, said spacer comber, and said cutting wheel comber are configured to be narrowed by respective corresponding surface grinding of respective side surfaces thereof; and said machine is configured to be overhauled, after said surface grinding and said corresponding surface grinding, by the addition of at least one of each of said cutting wheels, said annular spacer, said spacer combers and said cutting wheel spacers on said each cutting shaft.

15. The machine according to claim 12, wherein said lower end of said concave surface of said cutting wheel comber is at a second predetermined distance from said each cutting wheel and said second predetermined distance is larger than said first predetermined distance.

16. The machine according to claim 15, wherein said second predetermined distance is at least about three times said first predetermined distance.

* * * * *